US008371790B2

(12) United States Patent
Sigmar et al.

(10) Patent No.: US 8,371,790 B2
(45) Date of Patent: Feb. 12, 2013

(54) DERRICKLESS TUBULAR SERVICING SYSTEM AND METHOD

(75) Inventors: Axel M. Sigmar, Houston, TX (US); Keith J. Orgeron, Houston, TX (US)

(73) Assignee: T&T Engineering Services, Inc., Tomball, TX (US)

( * ) Notice: Subject to any disclaimer, the term of this patent is extended or adjusted under 35 U.S.C. 154(b) by 273 days.

(21) Appl. No.: 12/403,218

(22) Filed: Mar. 12, 2009

(65) Prior Publication Data

US 2010/0230166 A1 Sep. 16, 2010

(51) Int. Cl.
*E21B 19/00* (2006.01)

(52) U.S. Cl. ..... 414/22.55; 901/8

(58) Field of Classification Search ..... 166/382, 166/75.14, 85.5, 88.4; 175/423, 52, 85, 426; 403/367, 374.1; 414/22.51–22.59, 22.61–22.62, 414/745.1–745.4; 901/6, 8; 81/57.34
See application file for complete search history.

(56) References Cited

U.S. PATENT DOCUMENTS

| | | | |
|---|---|---|---|
| 62,404 | A | 2/1867 | Gile et al. |
| 184,168 | A | 11/1876 | Nickle |
| 364,077 | A | 5/1887 | Addis |
| 514,715 | A | 2/1894 | Jenkins |
| 1,175,792 | A | 3/1916 | Mickelsen |
| 1,264,867 | A | 4/1918 | Schuh |
| 1,312,009 | A | 8/1919 | Thrift |
| 1,318,789 | A | 10/1919 | Moschel |
| 1,369,165 | A | 2/1921 | Cochran et al. |
| 1,396,317 | A | 11/1921 | Boyter |
| 1,417,490 | A | 5/1922 | Brandon |
| 1,981,304 | A | 11/1934 | Brandt |
| 2,124,154 | A | 7/1937 | Sovincz |
| 2,147,002 | A | 2/1939 | Volpin |
| 2,327,461 | A | 8/1943 | Rowe |
| 2,369,534 | A | 2/1945 | Cohen |
| 2,382,767 | A | 8/1945 | Zeilman |

(Continued)

FOREIGN PATENT DOCUMENTS

| | | | |
|---|---|---|---|
| EP | 0 024 433 | A1 | 3/1981 |
| GB | 2264736 | A | 9/1993 |

(Continued)

OTHER PUBLICATIONS

U.S. Appl. No. 11/923,451, filed Oct. 24, 2007, Orgeron, Keith J.

(Continued)

*Primary Examiner* — Gregory Adams
(74) *Attorney, Agent, or Firm* — John G. Fischer, Esq.; Paul D. Lein, Esq.; Scheef & Stone, L.L.P.

(57) ABSTRACT

A derrickless system for servicing tubulars at a wellhead has a first tubular handling apparatus with a gripper positioned adjacent the wellhead where the gripper grips a surface of one of the tubulars, a second tubular handling apparatus with a gripper positioned adjacent the wellhead where the gripper grips a surface of another of the tubulars, and a slip assembly positioned in the wellhead. The slip assembly has a wedge bowl positioned at the wellhead that is suitable for receiving the tubular therein, and wedges positioned in the wedge bowl that are suitable for positioning between the wedge bowl and the tubular. Each of the grippers of the first and second tubular handling apparatus has a stab frame and three grippers attached to the stab frame.

25 Claims, 5 Drawing Sheets

U.S. PATENT DOCUMENTS

| | | | | |
|---|---|---|---|---|
| 2,476,210 | A | 7/1949 | Moore | |
| 2,497,083 | A | 2/1950 | Hildebrand | |
| 2,509,853 | A | 5/1950 | Wilson | |
| 2,535,054 | A | 12/1950 | Ernst et al. | |
| 2,592,168 | A | 8/1952 | Morris et al. | |
| 2,715,014 | A | 8/1955 | Garnett et al. | |
| 2,770,493 | A | 11/1956 | Fieber | |
| 2,814,396 | A | 11/1957 | Neal, Sr. | |
| 2,828,024 | A | 3/1958 | True | |
| 2,840,244 | A | 6/1958 | Thomas, Jr. | |
| 2,937,726 | A | 5/1960 | Manfred et al. | |
| 3,033,529 | A | 5/1962 | Pierrat | |
| 3,059,905 | A | 10/1962 | Tompkins | |
| 3,076,560 | A | 2/1963 | Bushong et al. | |
| 3,177,944 | A | 4/1965 | Knight | |
| 3,180,496 | A | 4/1965 | Smith | |
| 3,194,313 | A * | 7/1965 | Fanshawe | 166/77.53 |
| 3,262,593 | A | 7/1966 | Hainer | |
| 3,280,920 | A | 10/1966 | Scott | |
| 3,290,006 | A | 12/1966 | Dubberke | |
| 3,331,585 | A | 7/1967 | Dubberke | |
| 3,365,762 | A | 1/1968 | Spiri | |
| 3,432,159 | A | 3/1969 | Rakatansky | |
| 3,464,507 | A | 9/1969 | Alexander | |
| 3,477,522 | A | 11/1969 | Templeton | |
| 3,498,375 | A | 3/1970 | McEwen et al. | |
| 3,559,821 | A | 2/1971 | James | |
| 3,561,811 | A | 2/1971 | Turner, Jr. | |
| 3,633,771 | A | 1/1972 | Woolslayer et al. | |
| 3,682,259 | A * | 8/1972 | Cintract et al. | 175/85 |
| 3,702,640 | A * | 11/1972 | Cintract et al. | 175/85 |
| 3,703,968 | A | 11/1972 | Uhrich et al. | |
| 3,706,347 | A | 12/1972 | Brown | |
| 3,774,781 | A | 11/1973 | Merkley | |
| 3,792,783 | A | 2/1974 | Brown | |
| 3,797,672 | A | 3/1974 | Vermette | |
| 3,804,264 | A | 4/1974 | Hedeen et al. | |
| 3,805,463 | A | 4/1974 | Lang et al. | |
| 3,806,021 | A | 4/1974 | Moroz et al. | |
| 3,823,916 | A | 7/1974 | Shaw | |
| 3,848,850 | A | 11/1974 | Bemis | |
| 3,860,122 | A | 1/1975 | Cernosek | |
| 3,883,009 | A | 5/1975 | Swoboda et al. | |
| 3,963,133 | A | 6/1976 | Gilli | |
| 3,986,619 | A | 10/1976 | Woolslayer et al. | |
| 3,991,887 | A | 11/1976 | Trout | |
| 3,995,746 | A | 12/1976 | Usagida | |
| 4,007,782 | A | 2/1977 | Nybo et al. | |
| 4,011,694 | A | 3/1977 | Langford | |
| 4,030,698 | A | 6/1977 | Hansen | |
| 4,044,952 | A | 8/1977 | Williams et al. | |
| 4,142,551 | A | 3/1979 | Wilms | |
| 4,172,684 | A | 10/1979 | Jenkins | |
| 4,269,554 | A | 5/1981 | Jackson | |
| 4,276,918 | A | 7/1981 | Sigouin | |
| 4,277,044 | A | 7/1981 | Hamilton | |
| 4,303,270 | A | 12/1981 | Adair | |
| 4,336,840 | A | 6/1982 | Bailey | |
| 4,359,089 | A | 11/1982 | Strate et al. | |
| 4,386,883 | A | 6/1983 | Hogan et al. | |
| 4,403,666 | A | 9/1983 | Willis | |
| 4,403,897 | A | 9/1983 | Willis | |
| 4,403,898 | A | 9/1983 | Thompson | |
| 4,407,629 | A | 10/1983 | Willis | |
| 4,420,917 | A | 12/1983 | Parlanti | |
| 4,426,182 | A | 1/1984 | Frias et al. | |
| 4,440,536 | A | 4/1984 | Scaggs | |
| 4,492,501 | A | 1/1985 | Haney | |
| 4,529,094 | A | 7/1985 | Wadsworth | |
| 4,547,110 | A | 10/1985 | Davidson et al. | |
| 4,595,066 | A | 6/1986 | Nelmark et al. | |
| 4,598,509 | A | 7/1986 | Woolslayer et al. | |
| 4,604,724 | A | 8/1986 | Shaginian et al. | |
| 4,605,077 | A | 8/1986 | Boyadjieff | |
| 4,658,970 | A | 4/1987 | Oliphant | |
| 4,688,983 | A | 8/1987 | Lindbom | |
| 4,708,581 | A | 11/1987 | Adair | |
| 4,756,204 | A | 7/1988 | Wittwer et al. | |
| 4,759,414 | A | 7/1988 | Willis | |
| 4,765,225 | A | 8/1988 | Birchard | |
| 4,765,401 | A | 8/1988 | Boyadjieff | |
| 4,822,230 | A | 4/1989 | Slettedal | |
| 4,834,604 | A | 5/1989 | Brittain et al. | |
| 4,982,853 | A | 1/1991 | Kishi | |
| 5,060,762 | A | 10/1991 | White | |
| 5,121,793 | A | 6/1992 | Busch et al. | |
| 5,135,119 | A | 8/1992 | Larkin | |
| 5,186,264 | A | 2/1993 | du Chaffaut | |
| 5,415,057 | A | 5/1995 | Nihei et al. | |
| 5,458,454 | A | 10/1995 | Sorokan | |
| 5,595,248 | A | 1/1997 | Denny | |
| 5,597,987 | A | 1/1997 | Gilliland et al. | |
| 5,609,226 | A | 3/1997 | Penisson | |
| 5,609,260 | A | 3/1997 | Liao | |
| 5,609,457 | A | 3/1997 | Burns | |
| 5,671,932 | A | 9/1997 | Chapman | |
| 5,806,589 | A | 9/1998 | Lang | |
| 5,816,565 | A | 10/1998 | McGuffin | |
| 5,848,647 | A | 12/1998 | Webre et al. | |
| 5,931,238 | A | 8/1999 | Gilmore et al. | |
| 5,934,028 | A | 8/1999 | Taylor | |
| 5,957,431 | A | 9/1999 | Serda, Jr. | |
| 5,964,550 | A | 10/1999 | Blandford et al. | |
| 5,988,299 | A | 11/1999 | Hansen et al. | |
| 5,992,801 | A | 11/1999 | Torres | |
| 5,993,140 | A | 11/1999 | Crippa | |
| 6,003,598 | A | 12/1999 | Andreychuk | |
| 6,047,771 | A | 4/2000 | Roynestad | |
| 6,053,255 | A | 4/2000 | Crain | |
| 6,079,490 | A | 6/2000 | Newman | |
| 6,079,925 | A | 6/2000 | Morgan et al. | |
| 6,158,516 | A | 12/2000 | Smith et al. | |
| 6,220,807 | B1 | 4/2001 | Sorokan | |
| 6,227,587 | B1 | 5/2001 | Terral | |
| 6,234,253 | B1 | 5/2001 | Dallas | |
| 6,253,845 | B1 | 7/2001 | Belik | |
| 6,263,763 | B1 | 7/2001 | Feigel, Jr. et al. | |
| 6,264,128 | B1 | 7/2001 | Shampine et al. | |
| 6,264,395 | B1 | 7/2001 | Allamon et al. | |
| 6,276,450 | B1 | 8/2001 | Seneviratne | |
| 6,279,662 | B1 | 8/2001 | Sonnier | |
| 6,311,788 | B1 | 11/2001 | Weixler | |
| 6,343,892 | B1 | 2/2002 | Kristiansen | |
| 6,398,186 | B1 | 6/2002 | Lemoine | |
| 6,431,286 | B1 | 8/2002 | Andreychuk | |
| 6,471,439 | B2 | 10/2002 | Allamon et al. | |
| 6,502,641 | B1 | 1/2003 | Carriere et al. | |
| 6,524,049 | B1 * | 2/2003 | Minnes | 414/22.51 |
| 6,543,551 | B1 | 4/2003 | Sparks et al. | |
| 6,543,555 | B2 | 4/2003 | Casagrande | |
| 6,550,128 | B1 | 4/2003 | Lorenz | |
| 6,557,641 | B2 | 5/2003 | Sipos et al. | |
| 6,564,667 | B2 | 5/2003 | Bayer et al. | |
| 6,581,698 | B1 * | 6/2003 | Dirks | 175/52 |
| 6,609,573 | B1 | 8/2003 | Day | |
| 6,705,414 | B2 | 3/2004 | Simpson et al. | |
| 6,745,646 | B1 | 6/2004 | Pietras et al. | |
| 6,748,823 | B2 | 6/2004 | Pietras | |
| 6,763,898 | B1 * | 7/2004 | Roodenburg et al. | 175/7 |
| 6,779,614 | B2 | 8/2004 | Oser | |
| 6,814,149 | B2 | 11/2004 | Liess et al. | |
| 6,845,814 | B2 | 1/2005 | Mason et al. | |
| 6,854,520 | B1 * | 2/2005 | Robichaux | 166/380 |
| 6,969,223 | B2 | 11/2005 | Tolmon et al. | |
| 7,017,450 | B2 | 3/2006 | Bangert | |
| 7,021,880 | B2 | 4/2006 | Morelli et al. | |
| 7,028,585 | B2 | 4/2006 | Pietras et al. | |
| 7,036,202 | B2 | 5/2006 | Lorenz | |
| 7,040,411 | B2 | 5/2006 | Kainer et al. | |
| 7,044,315 | B2 | 5/2006 | Willim | |
| 7,055,594 | B1 | 6/2006 | Springett et al. | |
| 7,077,209 | B2 | 7/2006 | McCulloch et al. | |
| 7,090,035 | B2 | 8/2006 | Lesko | |
| 7,090,254 | B1 | 8/2006 | Pietras et al. | |
| 7,117,938 | B2 | 10/2006 | Hamilton et al. | |
| 7,121,166 | B2 | 10/2006 | Drzewiecki | |
| 7,172,038 | B2 | 2/2007 | Terry et al. | |

| | | | | |
|---|---|---|---|---|
| 7,249,639 | B2 | 7/2007 | Belik | |
| 7,289,871 | B2 | 10/2007 | Williams | |
| 7,296,623 | B2 | 11/2007 | Koithan et al. | |
| 7,398,833 | B2 | 7/2008 | Ramey et al. | |
| 7,438,127 | B2 | 10/2008 | Lesko | |
| 7,503,394 | B2 * | 3/2009 | Bouligny | 166/380 |
| 7,726,929 | B1 * | 6/2010 | Orgeron | 414/22.55 |
| 7,918,636 | B1 * | 4/2011 | Orgeron | 414/22.55 |
| 7,946,795 | B2 | 5/2011 | Orgeron | |
| 7,980,802 | B2 | 7/2011 | Orgeron | |
| 8,011,426 | B1 | 9/2011 | Orgeron | |
| 8,128,332 | B2 | 3/2012 | Orgeron | |
| 8,172,497 | B2 | 5/2012 | Orgeron et al. | |
| 8,192,128 | B2 | 6/2012 | Orgeron | |
| 8,192,129 | B1 | 6/2012 | Orgeron | |
| 8,235,104 | B1 | 8/2012 | Sigmar et al. | |
| 2002/0070187 | A1 | 6/2002 | Willim | |
| 2002/0079105 | A1 | 6/2002 | Bergeron | |
| 2003/0170095 | A1 * | 9/2003 | Slettedal | 414/22.59 |
| 2003/0221871 | A1 | 12/2003 | Hamilton et al. | |
| 2004/0040926 | A1 | 3/2004 | Irsch et al. | |
| 2005/0269133 | A1 | 12/2005 | Little | |
| 2006/0016775 | A1 | 1/2006 | Willim | |
| 2006/0027793 | A1 | 2/2006 | Kysely | |
| 2006/0045654 | A1 | 3/2006 | Guidroz | |
| 2006/0151215 | A1 | 7/2006 | Skogerbo | |
| 2006/0278400 | A1 * | 12/2006 | Bouligny | 166/379 |
| 2008/0023432 | A1 | 1/2008 | Paschke | |
| 2008/0078965 | A1 | 4/2008 | Lane et al. | |
| 2008/0174131 | A1 | 7/2008 | Bouligny et al. | |
| 2008/0202812 | A1 * | 8/2008 | Childers et al. | 175/52 |
| 2008/0253866 | A1 | 10/2008 | Lops et al. | |
| 2009/0232624 | A1 * | 9/2009 | Orgeron | 414/22.55 |
| 2010/0032213 | A1 | 2/2010 | Orgeron | |
| 2010/0034619 | A1 * | 2/2010 | Orgeron | 414/22.55 |
| 2010/0034620 | A1 * | 2/2010 | Orgeron | 414/22.55 |
| 2010/0187740 | A1 | 7/2010 | Orgeron | |
| 2010/0230166 | A1 * | 9/2010 | Sigmar et al. | 175/52 |
| 2010/0254784 | A1 * | 10/2010 | Orgeron et al. | 414/22.55 |
| 2010/0296899 | A1 * | 11/2010 | Orgeron | 414/22.55 |
| 2011/0030942 | A1 | 2/2011 | Orgeron | |
| 2011/0200412 | A1 | 8/2011 | Orgeron | |
| 2012/0118639 | A1 | 5/2012 | Gerber | |
| 2012/0170998 | A1 | 7/2012 | Orgeron | |

FOREIGN PATENT DOCUMENTS

| | | | |
|---|---|---|---|
| JP | 05-044385 | A | 2/1993 |
| JP | 2001-287127 | A | 10/2001 |
| WO | 93/015303 | A1 | 8/1993 |
| WO | WO 02057593 | A1 * | 7/2002 |
| WO | WO 2006038790 | A1 * | 4/2006 |

OTHER PUBLICATIONS

U.S. Appl. No. 11/923,451, filed Oct. 24, 2007; non-published; titled "Pipe Handling Apparatus and Method" and having a common inventor with the present application.

Chronis, Nicholas P.; Mechanisms & Mechanical Devices Sourcebook, 1991, Ch. 10, pp. 399-414, ISBN 0-07-010918-4, McGraw-Hill, Inc.

U S Appl. No. 12/111,907, filed Apr. 29, 2008; non-published; titled "Pipe Gripping Apparatus" and having common inventors with the present patent application.

U.S. Appl. No. 12/371,590, filed Feb. 14, 2009; non-published; titled "Tubular Gripping Apparatus" and having common inventors with the present patent application.

U.S. Appl. No. 12/371,593, filed Feb. 14, 2009; non-published; titled "Pipe Handling Apparatus With Stab Frame Stiffening" and having common inventors with the present patent application.

U.S. Appl. No. 12/632,261, filed Dec. 7, 2009; non-published; titled "Stabbing Apparatus and Method" and having common inventors with the present patent application.

U.S. Appl. No. 12/633,891, filed Dec. 9, 2009; non-published; titled "Stabbing Apparatus for Centering Tubulars and Casings for Connection at a Wellhead" and having common inventors with the present patent application.

U.S. Appl. No. 13/114,842, filed May 24, 2011; non-published; titled "Telescoping Jack for a Gripper Assembly" and having common inventors with the present patent application.

U.S. Appl. No. 13/226,343, filed Sep. 6, 2011; non-published; titled "Method of Gripping a Tubular With a Tubular Gripping Mechanism" and having common inventors with the present patent application.

* cited by examiner

DERRICKLESS TUBULAR SERVICING SYSTEM AND METHOD

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a tubular handling apparatus. More particularly, the present invention relates to the delivery of a tubular to and from a wellhead. More particularly, the present invention relates to the delivery of the tubular to and from a wellhead without the use of an oil derrick.

2. Description of Related Art Including Information Disclosed Under 37 CFR 1.97 and 37 CFR 1.98.

Drill rigs have utilized several methods for transferring tubular members from a tubular rack adjacent to the drill floor to a mousehole in the drill floor or the wellbore for connection to a previously transferred tubular. The term "tubular" as used herein includes all forms of drill tubulars, drill collars, pipes, casing, liner, bottom hole assemblies (BHA), and other types of tubulars known in the art.

Conventionally, drill rigs have utilized a combination of the rig cranes and the traveling system for transferring a tubular from the tubular rack to a vertical position above the center of the well. The obvious disadvantage with the prior art systems is that there is a significant manual involvement in attaching the tubular elevators to the tubular and moving the tubular from the drill rack to the rotary table. This manual transfer operation in the vicinity of workers is potentially dangerous and has caused numerous injuries in drilling operations. Further, the hoisting system may allow the tubular to come into contact with the catwalk or other portions of the rig as the tubular is transferred from the tubular rack to the drill floor. This can damage the tubular and may affect the integrity of the connections between successive tubulars in the well.

One method of transferring a tubular from the rack to the well platform comprises tying one end of a line on the rig around a selected tubular on the tubular rack. The tubular is thereafter lifted up onto the platform and the lower end thereof is placed into the mousehole. The mousehole is simply an upright, elongate cylindrical container adjacent the rotary table which supports the tubular temporally. When it is necessary to add the tubular to the drill string, slips are secured about the drill string on the rotary table thereby supporting the same in the wellbore. The tubular is disconnected from the traveling equipment and the elevators, or the kelly, are connected to the tubular in the mousehole. Next, the traveling block is raised thereby positioning the tubular over the drill string and tongs are used to secure the tubular to the upper end of the drill string. The drill tubular elevators suspend the drill tubular from a collar which is formed around one end of the tubular and do not clamp the tubular thereby permitting rotational tubular movement in order to threadably engage the same to the drill string.

A prior art technique for moving joints of casing from racks adjacent to the drilling rig comprises tying a line from the rig onto one end of a selected casing joint on the rack. The line is raised by lifting the casing joint up a ramp leading to the rig platform. As the rope lifts the casing from the rack, the lower end of the casing swings across the platform in a dangerous manner. The danger increases when a floating system is used in connection with drilling. Since the rope is tied around the casing at one end thereof, the casing does not hang vertically, but rather tilts somewhat. A man working on a platform elevated above the rig floor must hold the top of the casing and straighten it out while the casing is threaded into the casing string which is suspended in the wellbore by slips positioned on the rotary table.

It would be desirable to be able to grip a casing or a tubular positioned on a rack adjacent a drilling well, move the same into vertical orientation over the wellbore, and thereafter lower the same onto the string suspended in the wellbore.

In the past, various devices have been created which mechanically move a tubular from a horizontal orientation to a vertical orientation such that the vertically oriented tubular can be installed into the wellbore. Typically, these devices have utilized several interconnected arms that are associated with a main rotating structural member. In order to move the tubular, a succession of individual movements of the levers, arms, and other components of the boom must be performed in a coordinated manner in order to achieve the desired result. Typically, a wide variety of hydraulic actuators are connected to each of the components so as to carry out the prescribed movement. A complex control mechanism is connected to each of these actuators so as to achieve the desired movement. Advanced programming is required of the controller in order to properly coordinate the movements in order to achieve this desired result.

Unfortunately, with such systems, the hydraulic actuators, along with other components, can become worn with time. Furthermore, the hydraulic integrity of each of the actuators can become compromised over time. As such, small variations in each of the actuators can occur. These variations, as they occur, can make the complex mechanism rather inaccurate. The failure of one hydraulic component can exacerbate the problems associated with the alignment of the tubular in a vertical orientation. Adjustments of the programming are often necessary so as to continue to achieve the desired results. Fundamentally, the more hydraulic actuators that are incorporated into such a system, the more likely it is to have errors, inaccuracies, and deviations in the desired delivery profile of the tubular. Typically, very experienced and knowledgeable operators are required so as to carry out this tubular movement operation. This adds significantly to the cost associated with tubular delivery. A tubular can be a casing, a tubular, or any other tubular structure associated with the oil and gas production.

A typical oil well has an oil derrick centered over the wellhead. An oil derrick is a specific type of derrick that is used over oil and gas wells and other drilled holes. The oil derrick is used to position tubulars over the wellhead for insertion and removal therefrom. Oil derricks are typically structures of a steel framework that are immobile. A typical oil derrick has a number of complex machines designed specifically to perform a specific function for delivering and removing tubulars to and from the wellhead, in addition to having machinery for drilling the well and producing the oil and/or gas. An oil derrick can also control the weight of a drill bit. Each type of drill bit has an optimum pressure at which it should be pushed through the earth for drilling a well. An oil derrick can be used to control this pressure. An oil derrick can include a boom so as to deliver equipment to and from the wellhead using the structure of the oil derrick as support. Oil derricks are most advantageous for oil wells that have a long life expectancy for producing oil. However, large deposits of oil are becoming increasingly rare, and permanent oil derricks of the past are sometimes not suitable for modern oil wells. Typical oil derricks require a large number of experienced workers to operate the machines and equipment associated with the derrick. Workers commonly associated with oil derricks are geologists, engineers, mechanics, and safety inspectors.

An oil derrick has to be assembled on-site at the well location. This requires materials to be delivered from the manufacturing plant to the location of the well so as to construct the derrick. Thus, certain costs are associated with the manufacturing, delivery, and construction of oil and gas derricks for a well. In addition to these costs, the cost of tearing down the oil well and removing it from the well site adds to the overall costs of oil and gas production. Because the costs of using an oil and gas derrick can be extremely large, there is a need for a way to deliver tubulars to and from a wellhead without the use of a derrick.

Another problem associated with the insertion and removal of tubulars that make up part of a string of tubulars in a wellbore is that the tubulars can slip into the well bore if not held at the surface. Tubulars can fall deep within the wellbore, and the cost of recovery of the tubular can be quite expensive. Moreover, a tubular that falls in the wellbore can become stuck within the wellbore. Thus, there is a need to keep the upper end of the tubular from falling into the depths of the wellbore while tubulars are delivered to and from the tubular for insertion and removal of tubulars at the wellhead.

In the past, various patents have issued relating to such tubular handling devices. For example, U.S. Pat. No. 3,177,944, issued on Apr. 13, 1965 to R. N. Knight, describes a racking mechanism for earth boring equipment that provides for horizontal storage of pipe lengths on one side of and clear of the derrick. This is achieved by means of a transport arm which is pivoted toward the base of the derrick for swing movement in a vertical plane. The outer end of the arm works between a substantially vertical position in which it can accept a pipe length from, or deliver a pipe length to, a station in the derrick, and a substantially horizontal portion in which the arm can deliver a pipe length to, or accept a pipe length from, a station associated with storage means on one side of the derrick.

U.S. Pat. No. 3,464,507, issued on Sep. 2, 1969 to E. L. Alexander et al., teaches a portable rotary pipe handling system. This system includes a mast pivotally mounted and movable between a reclining transport position to a desired position at the site drilling operations which may be at any angle up to vertical. The mast has guides for a traveling mechanism that includes a block movable up and down the mast through operation of cables reeved from the traveling block over crown block pulleys into a drawwork. A power drill drive is carried by the traveling block. An elevator for drill pipe is carried by arm swingably mounted relative to the power unit. Power tongs, slips, and slip bushings are supported adjacent the lower end of the mast and adapted to have a drill pipe extend therethrough from a drive bushing connected to a power drive whereby the drill pipe is extended in the direction of the hole to be drilled.

U.S. Pat. No. 3,633,771, issued on Jan. 11, 1972 to Woolslayer et al., discloses an apparatus for moving drill pipe into and out of an oil well derrick. A stand of pipe is gripped by a strong back which is pivotally mounted to one end of a boom. The boom swings the strongback over the rotary table thereby vertically aligning the pipe stand with the drill string. When both adding pipe to and removing pipe from the drill string, all vertical movement of the pipe is accomplished by the elevator suspended from the traveling block.

U.S. Pat. No. 3,860,122, issued on Jan. 14, 1975 to L. C. Cernosek, describes an apparatus for transferring a tubular member, such as a pipe, from a storage area to an oil well drilling platform. The positioning apparatus includes a pipe positioner mounted on a platform for moving the pipe to a release position whereby the pipe can be released to be lowered to a submerged position. A load means is operably attached or associated with the platform and positioning means in order to move the pipe in a stored position to a transfer position in which the pipe is transferred to the positioner. The positioner includes a tower having pivotally mounted thereon a pipe track with a plurality of pipe clamp assemblies which are adapted to receive a pipe length. The pipe track is pivotally movable by hydraulic power means or gear means between a transfer position in which pipe is moved into the plurality of clamp assemblies and the release position in which the pipe is released for movement to a submerged position.

U.S. Pat. No. 3,986,619, issued on Oct. 19, 1976 to Woolslayer et al., shows a pipe handling apparatus for an oil well drilling derrick. In this apparatus, the inner end of the boom is pivotally supported on a horizontal axis in front of a well. A clamping means is pivotally connected to the outer end of the boom on an axis parallel to the horizontal axis at one end. The clamping means allows the free end of the drill pipe to swing across the boom as the outer end of the boom is raised or lowered. A line is connected at one end with the traveling block that raises and lowers the elevators and at the other end to the boom so as to pass around sheaves.

U.S. Pat. No. 4,172,684, issued on Oct. 30, 1979 to C. Jenkins, shows a floor level pipe handling apparatus which is mounted on the floor of an oil well derrick suitable structure. This apparatus includes a support that is rockable on an axis perpendicular to the centerline of a well being drilled. One end of an arm is pivotally mounted on the support on an axis transverse to the centerline of the well. The opposite end of the arm carries a pair of shoes having laterally opening pipe-receiving seats facing away from the arm. The free end of the arm can be swung toward and away from the well centerline and the arm support can be rocked to swing the arm laterally.

U.S. Pat. No. 4,403,666, issued on Sep. 13, 1983 to C. A. Willis, shows self-centering tongs and a transfer arm for a drilling apparatus. The clamps of the transfer arm are resiliently mounted to the transfer arm so as to provide limited axial movement of the clamps and thereby of a clamped down hole tubular. A pair of automatic, self-centering, hydraulic tongs is provided for making up and breaking out threaded connections of tubulars.

U.S. Pat. No. 4,407,629, issued on Oct. 4, 1983 to C. A. Willis, teaches a lifting apparatus for downhole tubulars. This lifting apparatus includes two rotatably mounted clamps which are rotatable between a side loading-position so as to facilitate the loading and unloading in the horizontal position, and a central position, in which a clamped tubular is aligned with the drilling axis when the boom is in the vertical position. An automatic hydraulic sequencing circuit is provided to automatically rotate the clamps into the side-loading position whenever the boom is pivoted with a down-hole tubular positioned in the clamp. In this position, the clamped tubular is aligned with a safety plate mounted on the boom to prevent a clamped tubular from slipping from the clamps.

U.S. Pat. No. 4,492,501, provides a platform positioning system for a drilling operation which includes a support structure and a transfer arm pivotally connected to the support structure to rotate about a first axis. This platform positioning system includes a platform which is pivotally connected to the support structure to rotate about a second axis, and rod which is mounted between the transfer arm and the platform. The position of the arm and platform axes and the length of the rod are selected such that the transfer arm automatically and progressively raises the platform to the raised position by means of the rod as the transfer arm moves to the raised position. The transfer arm automatically and progressively lowers the platform to the lowered position by means of the rod as the transfer arm moves to the lowered position.

U.S. Pat. No. 4,595,066, issued on Jun. 17, 1986 to Nelmark et al., provides an apparatus for handling drill pipes and used in association with blast holes. This system allows a drill pipe to be more easily connected and disconnected to a drill string in a hole being drilled at an angle. A receptacle is formed at the lower end of the carrier that has hydraulically operated doors secured by a hydraulically operated lock. A gate near the upper end is pneumatically operated in response to the hydraulic operation of the receptacle lock.

U.S. Pat. No. 4,822,230, issued on Apr. 18, 1989 to P. Slettedal, teaches a pipe handling apparatus which is adapted for automated drilling operations. Drill pipes are manipulated between substantially horizontal and vertical positions. The apparatus is used with a top mounted drilling device which is rotatable about a substantially horizontal axis. The apparatus utilizes a strongback provided with clamps to hold and manipulate pipes. The strongback is rotatably connected to the same axis as the drilling device. The strongback moves up or down with the drilling device. A brace unit is attached to the strongback to be rotatable about a second axis.

U.S. Pat. No. 4,834,604, issued on May 30, 1989 to Brittain et al., provides a pipe moving apparatus and method for moving casing or pipe from a horizontal position adjacent a well to a vertical position over the wellbore. The machine includes a boom movable between a lowered position and a raised position by a hydraulic ram. A strongback grips the pipe and holds the same until the pipe is vertically positioned. Thereafter, a hydraulic ram on the strongback is actuated thereby lowering the pipe or casing onto the string suspended in the wellbore and the additional pipe or casing joint is threaded thereto.

U.S. Pat. No. 4,708,581, issued on Nov. 24, 1987 to H. L. Adair, provides a method for positioning a transfer arm for the movement of drill pipe. A drilling mast and a transfer arm is mounted at a first axis adjacent the mast to move between a lowered position near ground level and an upper position aligned with the mast. A reaction point anchor is fixed with respect to the drilling mast and spaced from the first axis. A fixed length link is pivotally mounted to the transfer arm at a second axis, spaced from the first axis, and a first single stage cylinder is pivotally mounted at one end to the distal end of the link and at the other end to the transfer arm. A second single stage hydraulic cylinder is pivotally mounted at one end to the distal end of the link and at the other end to the reaction point.

U.S. Pat. No. 4,759,414, issued on Jul. 26, 1988 to C. A. Willis, provides a drilling machine which includes a drilling superstructure skid which defines two spaced-apart parallel skid runners and a platform. The platform supports a drawworks mounted on a drawworks skid and a pipe boom is mounted on a pipe boom skid sized to fit between the skid runners of the drilling substructure skid. The drilling substructure skid supports four legs which, in turn, support a drilling platform on which is mounted a lower mast section. The pipe boom skid mounts a pipe boom as well as a boom linkage, a motor, and a hydraulic pump adapted to power the pipe boom linkage. Mechanical position locks hold the upper skid in relative position over the lower skid.

U.S. Pat. No. 5,458,454, issued on Oct. 17, 1995 to R. S. Sorokan, describes a pipe handling method which is used to move tubulars used from a horizontal position on a pipe rack adjacent the wellbore to a vertical position over the well center. This method utilizes bicep and forearm assemblies and a gripper head for attachment to the tubular. The path of the tubular being moved is close to the conventional path of the tubular utilizing known cable transfer techniques so as to allow access to the drill floor through the V-door of the drill rig. U.S. Pat. No. 6,220,807 describes apparatus for carrying out the method of U.S. Pat. No. 5,458,454.

U.S. Pat. No. 6,609,573, issued on Aug. 26, 2003 to H. W. F. Day, teaches a pipe handling system for an offshore structure. The pipe handling system transfers the pipes from a horizontal pipe rack adjacent to the drill floor to a vertical orientation in a set-back area of the drill floor where the drill string is made up for lowering downhole. The cantilevered drill floor is utilized with the pipe handling system so as to save platform space.

U.S. Pat. No. 6,705,414, issued on Mar. 16, 2004 to Simpson et al., describes a tubular transfer system for moving pipe between a substantial horizontal position on the catwalk and a substantially vertical position at the rig floor entry. Bundles of individual tubulars are moved to a process area where a stand make-up/break-out machine makes up the tubular stands. The bucking machine aligns and stabs the connections and makes up the connection to the correct torque. The tubular stand is then transferred from the machine to a stand storage area. A trolley is moved into position over the pick-up area to retrieve the stands. The stands are clamped to the trolley and the trolley is moved from a substantially horizontal position to a substantially vertical position at the rig floor entry. A vertical pipe-racking machine transfers the stands to the traveling equipment. The traveling equipment makes up the stand connection and the stand is run into the hole.

U.S. Pat. No. 6,779,614, issued on Aug. 24, 2004 to M. S. Oser, shows another system and method for transferring pipe. A pipe shuttle is used for moving a pipe joint into a first position and then lifting upwardly toward an upper second position.

U.S. patent application Ser. No. 11/923,451, filed on Oct. 24, 2007 by the present inventor, discloses a pipe handling apparatus having a boom pivotally movable between a first position and a second position, a riser assembly pivotally connected to the boom, an arm pivotally connected at one end to the first portion of the riser assembly and extending outwardly therefrom, a gripper affixed to an opposite end of the arm suitable for gripping a diameter of the pipe, a link pivotally connected to the riser assembly and pivotable so as to move relative to the movement of the boom between the first and second positions, and a brace having a one end pivotally connected to the boom and an opposite end pivotally connected to the arm between the ends of the arm. The riser assembly has a first portion extending outwardly at an obtuse angle with respect to the second portion.

U.S. Pat. No. 7,398,833, issued on Jul. 15, 2008 to Ramey et al., discloses a tubular handling device that has slips, wherein the slips have an arcuate interface that has a longitudinally disposed slot and a ledge therein. An insert has a shoulder that is configured to fit within the ledge. The insert is capable of transferring a load from the shoulder to the ledge. The outer portion of the slips has a taper of greater than 11 degrees. A complementary bowl insert is provided with a matching taper. A method of handling tubular members on a drilling rig is also disclosed.

U.S. Pat. No. 6,557,641, issued on May 6, 2003 to Sipos et al., discloses a wellbore tubular handling system and method for holding and lowering tubulars, such as casing strings, at a rig site. The handling system utilizes interchangeable gripping modules for use with both the elevator slips and the spider. Because the gripping modules are completely interchangeable, only one additional gripping module is needed to provide redundancy at the well site so as to thereby reduce the equipment normally required. An elevator module receives the interchangeable gripping module therein. An interchangeable gripping module also is flushly mounted in many standard rotary tables. Alternatively a top mount spider module is provided to receive a gripping module for other rig floor and/or rotary table constructions. The gripping module has three inner support rings and slips between approximately one and two feet in length to permit load support while protecting any thin-walled casing that is used in the casing string.

U.S. Pat. No. 6,471,439, issued on Oct. 29, 2002 to Allamon et al., discloses slip assembly handling a drill pipe on a drilling rig that has slip segments assembled in a slip bowl. Each segment contains dies which grip the tubular member to prevent any axial displacement. The outer surface of the slip segment assembly is fully supported by the inner surface of the slip bowl such that no portion of the slip segment assembly extends below the bowl. The slip segments are of a forged steel material. Each die has a rounded bottom end with a tapered profile. Axial grooves are cut into each slip segment. The axial grooves have a rounded bottom.

U.S. Pat. No. 6,264,395, issued on Jul. 24, 2001 to Allamon et al., discloses slip assemblies for gripping drill pipe or other tubulars such that the load is distributed along the length of the dies of the slip segments. A load ring is positioned around the interior surface of each slip segment. Resilient members are positioned at the top surface of the uppermost die. Resilient members are positioned at the surface of the die that is positioned underneath the load ring.

U.S. Pat. No. 6,158,516, issued on Dec. 12, 2000 to Smith et al., discloses a method and apparatus for drilling, completion, working over, and controlling a well. The invention combines an integrated lifting unit and a coiled tubing unit. The method and apparatus permit running jointed pipe and coiled tubing in combination near the unit. The method and apparatus permit running standing multiple joints of pipe near the unit. The invention combines a hydraulic pipe hoisting system, pipe handling systems, and a pipe racking containment apparatus. A hydraulic workover jack is combined with a multifunction injector head and a standpipe for fluid circulation. The invention may also include a rotary table for rotating pipe and/or a rotating power swivel to allow fluid circulation during pipe rotation. Also included are a gin pole, a winching system for jointed pipe, and a traveling head with traveling slips and stationary slips to allow pipe movement in the well. Hydraulic systems allow insertion and extraction of tools in a work string. The apparatus includes a spoolable drill pipe that has a connector, multi-section reel with core, connection to reel for fluid circulation, reel drive mechanism and a pipe pulling capability. The method and apparatus do not require a derrick and can be derrickless.

U.S. Pat. No. 5,964,550, issued on Oct. 12, 1999 to Blandford et al., discloses a production platform that supports one or more decks above the water surface so as to accommodate equipment to process oil, gas, and water recovered from a subsea hydrocarbon formation. The platform is mounted on a single water surface-piercing column formed by one or more buoyancy tanks located below the water surface. The surface-piercing column includes a base structure that has three or more pontoons extending radially outwardly from the bottom of the surface piercing column. The production platform is secured to the seabed by one or more tendons per pontoon which are secured to the pontoons at one end and anchored to foundation piles embedded in the seabed at the other end. Installation of piles can be done without a derrick barge.

It is an object of the present invention to deliver to tubulars to and from a wellhead without the use of an oil and gas derrick.

It is another object of the present invention to hold an end of a tubular above the wellhead of the wellbore.

It is another object of the present invention to use multiple tubular handling apparatus to deliver tubulars to and from a tubular.

It is still another object of the present invention to prevent the sudden fall of a tubular into the depths of a wellbore.

It is another object of the present invention to deliver tubulars to and from a wellhead within a single degree of freedom so as to move the tubular without adjustments between the components of the tubular handling apparatus.

It is another object of the present invention to provide a derrickless system and method that may be transported on a skid or on a truck.

It is another object of the present invention to provide a derrickless system and method which allows for the self-centering of the tubular.

It is another object of the present invention to provide a derrickless system and method which may be utilized independent of the existing rig.

It is still a further object of the present invention to provide a derrickless system and method which avoids the use of multiple hydraulic cylinders and actuators.

It is still another object of the present invention to provide a derrickless system and method which minimizes the amount of instrumentation and controls utilized for carrying out the tubular handling activities.

It is still another object of the present invention to provide a derrickless system and method which allows for the tubular to be loaded beneath the lifting boom.

It is still a further object of the present invention to provide a derrickless system and method which is of minimal cost and easy to use.

It is still a further object of the present invention to provide a derrickless system and method which allows relatively unskilled workers to carry out the tubular handling activities.

These and other objects and advantages of the present invention will become apparent from a reading of the attached specification and appended claims.

BRIEF SUMMARY OF THE INVENTION

The present invention is a derrickless system for servicing tubulars at a wellhead comprising a first tubular handling apparatus having a gripper assembly positioned adjacent the wellhead, a second tubular handling apparatus having a gripper assembly positioned adjacent the wellhead, and a slip assembly positioned in the wellhead. The gripper assembly of the first tubular handling apparatus grips a surface of one of the tubulars. The gripper assembly of the second tubular handling apparatus grips a surface of another of the tubulars. The first tubular handling apparatus is suitable for moving the tubular from a stowed position to a position directly over the wellhead. The second tubular handling apparatus operates independently of the first tubular handling apparatus. The second tubular handling apparatus is suitable for moving another tubular from a stowed position to a position directly over the wellhead.

The slip assembly comprises a wedge bowl positioned at the wellhead, and a plurality of wedges positioned in the wedge bowl. The wedge bowl receives the tubular therein. The plurality of wedges is positioned between the wedge bowl and the tubular. The slip assembly is suitable for supporting a weight of the tubular. The wedge bowl has a wide end and a narrow end. The wide end has an inner diameter greater than an inner diameter of the narrow end. The plurality of wedges is positioned adjacent the wide end.

The gripper assembly of the first tubular handling apparatus comprises a stab frame, and a first gripper attached to a side of the stab frame. The first gripper is suitable for holding the tubular. The gripper assembly of the first tubular handling apparatus further comprises a second gripper attached to the side of the stab frame, and a third gripper attached to the side of the stab frame. The second gripper is positioned above the first gripper. The third gripper is positioned above the second gripper. At least one of the first, second, and third grippers is translatable along the stab frame. The gripper assembly of the second tubular handling apparatus comprises a stab frame, and a first gripper attached to a side of the stab frame of the gripper assembly of the second tubular handling apparatus. The first gripper of the gripper assembly of the second tubular handling apparatus is suitable for holding the tubular. The gripper assembly of the second tubular handling apparatus further comprises a second gripper attached to the side of the stab frame, and a third gripper attached to the side of the stab frame. The second gripper is positioned above the first gripper. The third gripper is positioned above the second gripper. At least one of the first, second, and third grippers of the second tubular handling apparatus is translatable along the stab frame of the second tubular handling apparatus. The first gripper of the gripper assembly of the first tubular handling apparatus grips the surface of the tubular when the first gripper of the gripper assembly of the second tubular handling apparatus holds the tubular. The gripper assembly of the first tubular handling apparatus is for gripping the surface of the tubular. The gripper assembly of the second tubular handling apparatus is for gripping the surface of the tubular. The first gripper of the gripper assembly of the second tubular handling apparatus grips the surface of the tubular when the first gripper of the gripper assembly of the first tubular handling apparatus holds the tubular.

The first tubular handling apparatus comprises a main rotating structural member pivotally movable between a first position and a second position, a lever assembly pivotally connected to the main rotating structural member where the lever assembly has a first portion extending outwardly at an obtuse angle with respect to a second portion, an arm pivotally connected at one end to the first portion of the lever assembly and extending outwardly therefrom, a link pivotally connected to the second portion of the lever assembly where the link pivots at an end of the second portion opposite of the first portion so as to move relative to the movement of the main rotating structural member between the first and second positions, and a brace having an end pivotally connected to the main rotating structural member and an opposite end pivotally connected to the arm. The stab frame of the gripper assembly of the first tubular handling apparatus is affixed to an opposite end of the arm. The first tubular handling apparatus further comprises a skid extending in a horizontal orientation and positioned below the main rotating structural member, and a vehicle having a bed receiving the skid thereon. The main rotating structural member is pivotally mounted upon the skid. The link has an end opposite the second portion of the lever assembly. The end of the link is pivotally mounted upon the skid in a position offset from and below the pivotal mounting of the main rotating structural member on the skid. The main rotating structural member may be a boom. The boom moves between the first and second positions within a single degree of freedom.

The second tubular handling apparatus comprises a main rotating structural member pivotally movable between a first position and a second position, a lever assembly pivotally connected to the main rotating structural member where the lever assembly has a first portion extending outwardly at an obtuse angle with respect to a second portion, an arm pivotally connected at one end to the first portion of the lever assembly and extending outwardly therefrom, a link pivotally connected to the second portion of the lever assembly where the link pivots at an end of the second portion opposite of the first portion so as to move relative to the movement of the main rotating structural member between the first and second positions, and a brace having an end pivotally connected to the main rotating structural member and an opposite end pivotally connected to the arm between the ends of the arm. The stab frame of the gripper assembly of the second tubular handling apparatus is affixed to an opposite end of the arm. The second tubular handling apparatus further comprises a skid extending in a horizontal orientation and positioned below the main rotating structural member, and a vehicle having a bed receiving the skid thereon. The main rotating structural member is pivotally mounted upon the skid. The link has an end opposite the second portion of the lever assembly. The end of the link is pivotally mounted upon the skid in a position offset from and below the pivotal mounting of the main rotating structural member on the skid. The main rotating structural member may be a boom. The boom moves between the first and second positions within a single degree of freedom.

The present invention is a method for servicing tubulars at a wellhead. The method includes the steps of gripping a first tubular by a tubular handling apparatus, moving the gripped first tubular from a stowed position to a position above the wellhead, gripping a second tubular by the tubular handling apparatus, moving the gripped second tubular from a stowed position to a position above the wellhead, engaging the moved second tubular into an end of the moved first tubular, releasing the first tubular from the tubular handling apparatus, gripping a third tubular by the tubular handling apparatus, moving the third gripped tubular from a stowed position to a position above an end of the second tubular opposite the first tubular, engaging an end of the third tubular into the end of the second tubular, lowering the first tubular and the engaged second tubular into a well bore below the wellhead, and fixing a position of the lowered first and second tubulars relative to the wellhead. The tubular handling apparatus comprises a first tubular handling apparatus and a second tubular handling apparatus. The first tubular handling apparatus is independent of the second tubular handling apparatus. The step of gripping the first tubular is accomplished by the first tubular handling apparatus. The step of gripping the second tubular is accomplished by the second tubular handling apparatus. The step of fixing comprises engaging one of the first and second tubulars by a slip assembly positioned at the wellhead. The step of moving the first tubular is in a single degree of freedom between the stowed position and the position above the wellhead. The step of moving the second tubular is in a single degree of freedom between the stowed position and the position above the wellhead.

DETAILED DESCRIPTION OF THE INVENTION

Figure 1:
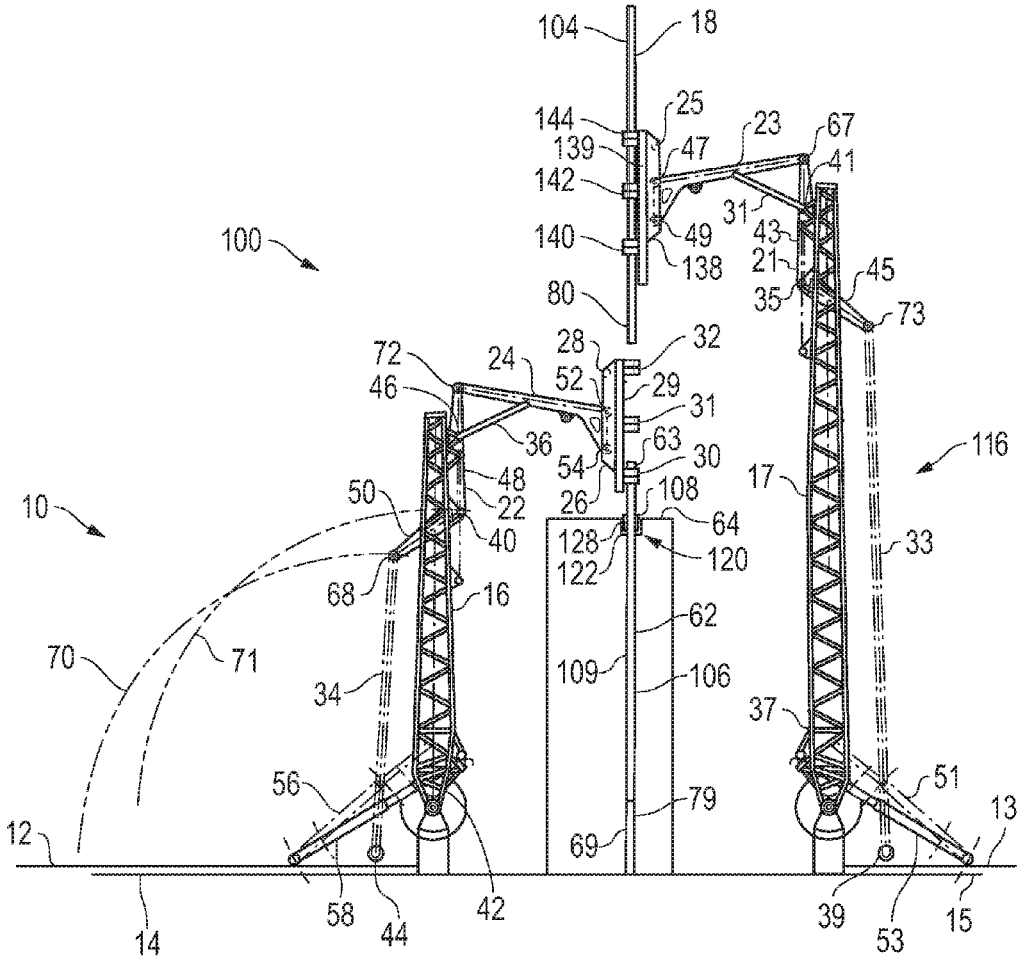
FIG. 1 shows a side elevational view of the preferred embodiment of the derrickless system of the present invention, with the first and second tubular handling apparatuses in the second position.

Referring to FIG. 1, there is shown a side elevational view of the preferred embodiment of the derrickless system 100 of the present invention. The derrickless system 100 is for servicing a tubular 18 and tubular 62 at a wellhead 108 of a wellbore 109. The derrickless system 100 has a first tubular handling apparatus 10, a second tubular handling apparatus 116, and a slip assembly 120. The tubular 18 is in a position directly over the wellhead 108. Tubulars 69 and 62 have already been delivered to the position directly over the wellhead 108, engaged with one another, and inserted into the wellbore 109. The first tubular handling apparatus 10 has a gripper assembly 26 positioned adjacent the wellhead 108. The gripper assembly 26 of the first tubular handling apparatus 10 grips a surface 106 of the tubular 62. The second tubular handling apparatus 116 has a gripper assembly 25 that is positioned adjacent the wellhead 108. The gripper assembly 25 of the second tubular handling apparatus 116 grips a surface 104 of the tubular 18. The slip assembly 120 is positioned in the wellhead 108. The tubular 62 is positioned in the wellbore 109. The tubular 62 extends through the slip assembly 120 so as to have an end 63 positioned above the wellhead 108 of the wellbore 109.

The slip assembly 120 has a wedge bowl 122 positioned at the wellhead 108 and wedges 128 positioned in the wedge bowl 122. The wedge bowl 122 receives the tubular 62 therein. The wedges 128 are positioned between the wedge bowl 122 and the surface 106 of the tubular 62. The slip assembly 120 is suitable for supporting a weight of the tubular 62. The slip assembly 120 is discussed in more detail below.

The gripper assembly 26 of the first tubular handling apparatus 10 has a stab frame 28, a first gripper 30 attached to a side 29 of the stab frame, a second gripper 31 attached to the side 29 of the stab frame 28, and a third gripper 32 attached to the side 29 of the stab frame 28. The first gripper 30 is suitable for holding the tubular 62. The second gripper 31 is positioned above the first gripper 30. The third gripper 32 is positioned above the second gripper 31. At least one of the grippers 30, 31, and 32 is translatable along the stab frame 28. The gripper assembly 25 of the second tubular handling apparatus 116 has a stab frame 138, a first gripper 140 attached to a side 139 of the stab frame 138, a second gripper 142 attached to the side 139 of the stab frame 138, and a third gripper 144 attached to the side 139 of the stab frame 138. The first gripper 140 of the second tubular handling apparatus 116 is suitable for holding the tubular 18. The second gripper 142 is positioned above the first gripper 140. The third gripper 144 is positioned above the second gripper 142. At least one of the grippers 140, 142, and 144 is translatable along the stab frame 138. The first gripper 30 of the gripper assembly 26 of the first tubular handling apparatus 10 grips the surface 106 of the tubular 62 when the first gripper 140 of the gripper assembly 25 of the second tubular handling apparatus 116 holds the surface 104 of the tubular 18. In an alternative embodiment, the gripper assembly 26 of the first tubular handling apparatus 10 grips the surface 104 of the tubular 18, and the gripper assembly 25 of the second tubular handling apparatus 116 grips the surface 106 of the tubular 62. That is, the first gripper 140 of the gripper assembly 25 of the second tubular handling apparatus 116 grips the surface 106 of the tubular 62 when the first gripper 30 of the gripper assembly 26 of the first tubular handling apparatus 10 holds the surface 104 of the tubular 18.

The preferred embodiment of the derrickless system 100 is shown in FIG. 1. In the preferred embodiment, the first gripper 30 of the gripper assembly 26 of the first tubular handling apparatus 10 holds the tubular 62 above the wellhead 108. End 63 of the tubular 62 extends above the first gripper 30. The end 63 may have a box formed thereon so that the box rests on the top of the first gripper 30. The box helps the first gripper 30 hold the tubular 62 so that the tubular 62 does not fall into the depths of the wellbore 109. The first tubular handling apparatus 10 and the second tubular handling apparatus 116 are shown in the second position. In the second position, the second tubular handling apparatus 116 holds the tubular 18 in a vertical orientation. The grippers 140, 142, and 144 of the gripper assembly 25 of the second tubular handling apparatus 116 are vertically aligned over the grippers 30, 31, and 32 of the gripper assembly 26 of the first tubular handling apparatus 10. The gripper assembly 25 of the second tubular handling apparatus 116 lowers the tubular 18 through the grippers 31 and 32 of the gripper assembly 26 of the first tubular handling apparatus 10 so that the lower end 80 of the tubular 18 meets with the end 63 of the tubular 62. The tubular 62 is typically made up of a series of tubulars that have been delivered by the second tubular handling apparatus 116 to the wellhead 108. The tubulars 18 may be any tubular structure associated with oil and gas drilling, such as tubular and casings. In the preferred embodiment, the gripper assembly 25 of the second tubular handling apparatus 116 is above the gripper assembly 26 of the first tubular handling apparatus 10. The grippers 31, 32, 140, 142, and 144 are configured so as to lower the tubular 18 to the tubular 62 and to rotate the tubular 18 so as to threadedly connect the end 80 of the tubular 18 with end 63 of the tubular 62. The grippers 31, 32, 140, 142, and 144 may also rotate the tubular 18 in an opposite direction so as to remove the tubular 18 from the tubular 62 when the tubular 62 is being removed from the wellbore 109. Because the tubular 62 and tubular 18 are handled by the first and second tubular handling apparatus 10 and 116, there is no need for a derrick. Usually, a large steel framework that constitutes a derrick is positioned on the drill floor 64 over the wellhead 108. The apparatus 100 and method of the present invention avoid the use of a derrick. By avoiding the use of derricks, costs associated with such derricks are eliminated. Additionally, the delivery of tubulars 18 to and from the wellhead 108 is accomplished with the mobile tubular handling apparatus 10 and 116, as opposed to using a permanently fixed oil and gas derrick. Thus, equipment is easily removed from the wellhead 108 when insertion or removal of tubulars 18 into the wellbore 109 is not needed. The tubular handling apparatuses 10 and 116 thus may be used in other locations while the wellhead 108 has no need for the insertion of tubulars 18. When the insertion and removal of tubulars 18 is needed at the wellhead 108, the mobile tubular handling apparatuses 10 and 116 may be easily moved to the location of the wellhead 108 for use.

Figure 2:
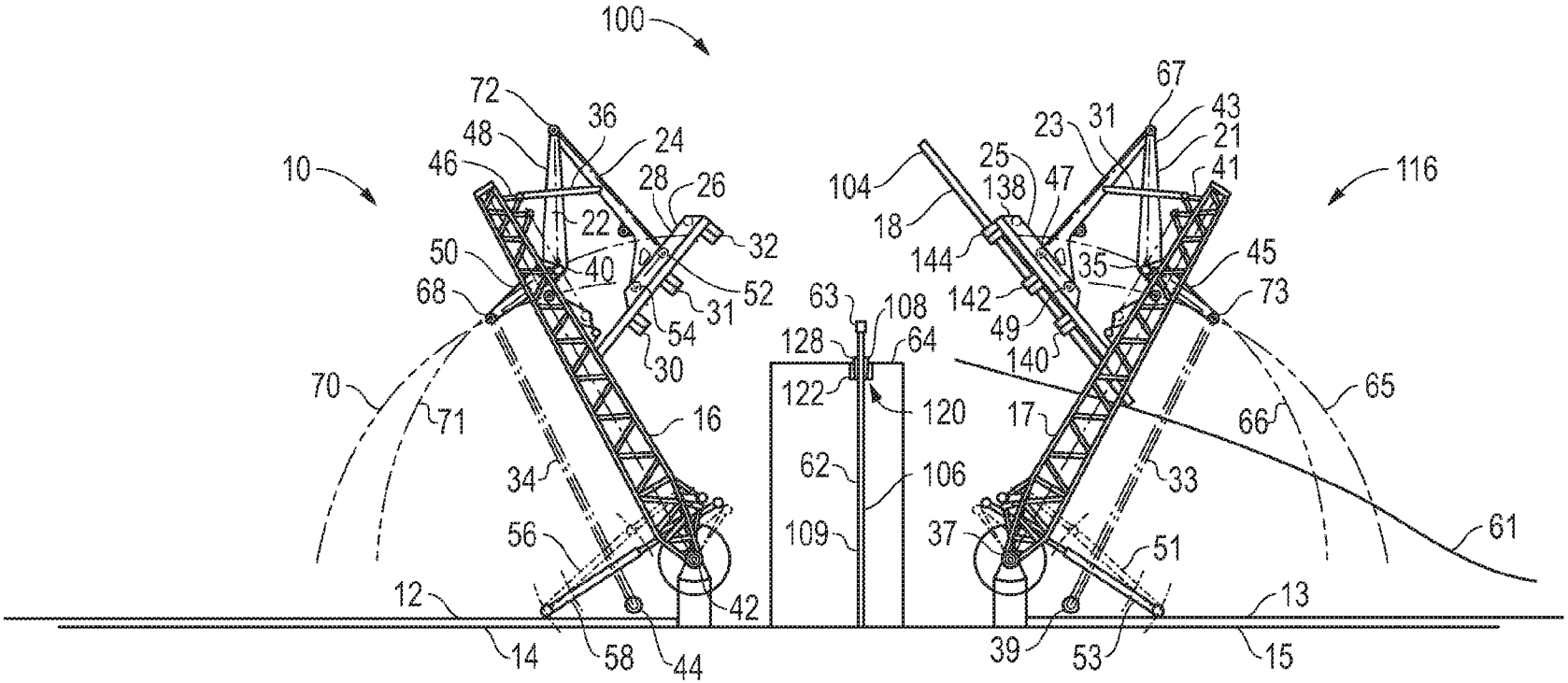
FIG. 2 shows a side elevational view of the preferred embodiment of the derrickless system of the present invention, with the first and second apparatuses in an intermediate position.

Referring to FIG. 2, there is shown a side elevational view of the preferred embodiment of the derrickless system 100 of the present invention. The first and second apparatuses 10 and 116 are shown in an intermediate position between the first and second positions. The first tubular handling apparatus 10 has a main rotating structural member 16 pivotally movable between a first position and a second position. A lever assembly 22 is pivotally connected to the main rotating structural member 16. The lever assembly 22 has a first portion 48 extending outwardly at an obtuse angle with respect to a second portion 50. An arm 24 is pivotally connected at one end to the first portion 48 of the lever assembly 22. The arm 24 extends outwardly from the first portion 48 of the lever assembly 22. A link 34 is pivotally connected to a second portion 50 of the lever assembly 22. The link 34 pivots at an end of the second portion 50 opposite of the first portion 48 so as to move relative to the movement of the main rotating structural member 16 between the first and second positions. A brace 36 has an end pivotally connected to a small frame member 46 of the main rotating structural member 16. An opposite end of the brace 36 is connected to the arm 24. The stab frame 28 of the gripper assembly 26 of the first tubular handling apparatus 10 is affixed to an opposite end of the arm 24. A skid 12 extends in a horizontal orientation. The skid 12 is positioned below the main rotating structural member 16. The main rotating structural member 16 is pivotally mounted upon the skid 12. A vehicle has a bed 14 that receives the skid 12. Thus, the first tubular handling apparatus 10 may be moved from location to location with ease. The link 34 has an end 44 opposite the second portion 50 of the lever assembly 22. The end 44 of the link 34 is pivotally mounted upon the skid 12 in a position offset from and below the pivotal mounting 42 of the main rotating structural member 16 on the skid 12. The main rotating structural member 16 may be a boom. The boom moves between the first and second positions within a single degree of freedom.

The second tubular handling apparatus 116 has main rotating structural member 17 that is movable between a first position and a second position. A lever assembly 21 is pivotally connected to the main rotating structural member 17. The lever assembly 21 has a first portion 43 extending outwardly at an obtuse angle with respect to a second portion 45. An arm 23 is pivotally connected at one end to the first portion 43 of the lever assembly 21. The arm 23 extends outwardly from the first portion 43 of the lever assembly 21. A link 33 is pivotally connected to a second portion 45 of the lever assembly 21. The link 33 pivots at an end of the second portion 45 of lever assembly 21 opposite of the first portion 43 so as to move relative to the movement of the main rotating structural member 17 between the first and second positions. A brace 31 has an end pivotally connected to a small frame member 41 of the main rotating structural member 17. An opposite end of the brace 31 is connected to the arm 23 between the ends of the arm 23. The stab frame 138 of the gripper assembly 25 of the second tubular handling apparatus 116 is affixed to an opposite end of the arm 23. A skid 13 extends in a horizontal orientation. The skid 13 is positioned below the main rotating structural member 17. The main rotating structural member 17 is pivotally mounted upon the skid 13. A vehicle has a bed 15 that receives the skid 13. The link 33 has an end opposite the second portion 45 of the lever assembly 21. The end of the link 33 is pivotally mounted upon the skid 13 in a position offset from and below the pivotal mounting 75 of the main rotating structural member 17 on the skid 13. The main rotating structural member 17 may be a boom. The boom moves between the first and second positions within a single degree of freedom. The skids 12 and 13 of the first and second tubular handling apparatuses 10 and 116 are positioned at a height lower than a height of the wellhead 108. The tubular 62 extends outwardly of the wellbore 109 so that end 63 of the tubular 62 extends above the wellhead 108.

In FIG. 2, tubular 18 is being delivered by the second tubular handling apparatus 116 along path 61. Pivot point 73 between the link 33 and the lever assembly 21 moves along path 65 when moving from the first and second positions. Lug 35 of the lever assembly 21 moves along path 66 when moving between the first and second positions. Pivot point 68 that connects the second portion 50 of the lever assembly 22 of the first tubular handling apparatus 10 with the link 34 moves along the path 70 when the first tubular handling apparatus 10 moves between the first and second positions. Lug 40 of the lever assembly 22 moves along path 71 when the first tubular handling apparatus 10 moves between the first and second positions. Wedges 128 that are positioned between the surface 106 of the tubular 62 and the wedge bowl 122 of the slip assembly 120 hold the end 63 of the tubular 62 above the wellhead 108. Without the slip assembly 120, the tubular 62 would fall into the depths of the wellbore 109. Although both the first and second tubular handling apparatuses 10 and 116 of the derrickless system 100 are shown in the intermediate position in FIG. 2, the tubular handling apparatuses 10 and 116 may move independently between the first and second positions of each apparatus 10 and 116. Thus, the second tubular handling apparatus 116 may be in the first position while the first tubular handling apparatus 10 is in the second position. Conversely, the first tubular handling apparatus 10 may be in the first position while the second tubular handling apparatus 116 may be in the second position. In using the derrickless system 100 of the present invention, the well floor is typically located at a height greater than a height of the skids 12 and 13 of the first and second tubular handling apparatuses 10 and 116.

In the present invention, the main rotating structural members 16 and 17 of the first and second tubular handling apparatuses 10 and 116, respectively, are a structural frame work of struts, crossmembers, and beams. Although oil derricks are also structural frame works, the main rotating structural members 16 and 17 of the present invention are far smaller than typical oil and gas derricks, are mobile as opposed to stationary, and may pivot with respect to a horizontal surface. The main rotating structural members 16 and 17 are configured so as to have an open interior such that the tubular 18 may be lifted in a manner so as to pass through the interior of the main rotating structural members 16 and 17. As such, the upper ends of the main rotating structural members 16 and 17, respectively, should be strongly reinforced so as to provide the necessary structural and integrity to the main rotating structural members 16 and 17. A lug 40 extends outwardly from one side of the main rotating structural member 16. A lug 35 extends outwardly from one side of the main rotating structural member 17. These lugs 40 and 35 are suitable for pivotal connection to the lever assemblies 22 and 21, respectively. The main rotating structural members 16 and 17 are pivotally connected opposite ends 42 and 37 to a location on the skids 12 and 13. The pivotable connections at ends 42 and 37 of the main rotating structural members 16 and 17 are located in offset relationship and above the pivotal connections 44 and 39 of the links 34 and 33 with the skids 12 and 13. Small frame members 46 and 41 extend outwardly from the side of the main rotating structural members 16 and 17 opposite the links 34 and 33. The frame members 46 and 41 have a pivotal connection with each of the respective braces 36 and 31. The unique arrangement of the lever assemblies 22 and 21 of the first and second tubular handling apparatuses 10 and 116 facilitate the ability of the derrickless system 100 of the present invention to carry out the movement of the tubular 18 between the horizontal and vertical orientations.

Referring still to FIG. 2, a pair of pin connections 52 and 54 fixedly position the stab frame 28 of the gripper assembly 26 of the first tubular handling apparatus 10 with respect to the end of the arm 24. Similarly, pin connections 47 and 49 fixedly position the stab frame 138 of the gripper assembly 25 of the second tubular handling apparatus 116 with respect to the end of the arm 23. Pin connections 52, 54, 47 and 49 may be in the nature of bolts, or other fasteners, so as to strongly connect the stab frames 28 and 138 of the gripper assemblies 26 and 25 with the arms 24 and 23, respectively. The pin connections 52, 54, 47 and 49 may be removed so that different embodiments of the gripper assemblies 26 and 25 may be placed on the arms 24 and 23. As such, the tubular handling apparatuses 10 and 116 of the derrickless system 100 of the present invention may be adaptable to various sizes of tubulars 18, including various diameters and lengths.

Grippers 30, 31, and 32 of the gripper assembly 26 of the first tubular handling apparatus 10 are translatable along the length of the stab frame 28. Likewise, the grippers 140, 142 and 144 of the gripper assembly 25 of the second tubular handling apparatus 116 are translatable along the length of the stab frame 138. The translation of the grippers 30, 31, 32, 140, 142, and 144 allows the tubular 18 and tubular 62 to be properly moved upwardly and downwardly when the first and second tubular handling apparatuses 10 and 116 are in the second position. The grippers 30, 31, 32, 140, 142, and 144 are in the nature of the conventional grippers that can open and close so as to engage the surface 104 of the tubular 18 and the surface 106 of the tubular 62.

The links 34 and 33 are elongate members that extend from the pivotable connections 44 and 39 to the pivotable connections 68 and 73 of the second portions 50 and 45 of the lever assemblies 22 and 21, respectively. The links 34 and 33 extend generally adjacent to the opposite side of the main rotating structural members 16 and 17 from that of the arms 24 and 23. The links 34 and 33 will generally move relative to the movement of the main rotating structural members 16 and 17. The braces 36 and 31 are pivotally connected to the small frame members 46 and 41 associated with the main rotating structural members 16 and 17. The braces 36 and 31 are also pivotally connected at a location along the arms 24 and 23 between the ends of each. Braces 36 and 31 provide structural support to the arms 24 and 23 and also facilitate the desired movement of the arms 24 and 23 during the movement of the tubular 18 between the horizontal orientation and the vertical orientation.

Actuators 56 and 58 are illustrated as having one end connected to the skid 12 and an opposite end connected to the main rotating structural member 16 in a location above the end 42. When the actuators 56 and 58 are activated, they will pivot the main rotating structural member 16 upwardly from the horizontal orientation ultimately to a position beyond vertical so as to cause the tubular 18 to achieve vertical orientation. Within the concept of the present invention, a single hydraulic actuator may be utilized instead of the pair of hydraulic actuators 56 and 58, as illustrated in FIG. 1. Actuators 51 and 53 of the second tubular handling apparatus 116 are illustrated as having one end connected to the skid 13 and an opposite end connected to the main rotating structural member 17 in a location above the end 37. When the actuators 51 and 53 are activated, they will pivot the main rotating structural member 17 upwardly from the horizontal orientation ultimately to a position beyond vertical (the second position) so as to cause the tubular 18 to achieve vertical orientation. Within the concept of the present invention, a single hydraulic actuator may be utilized instead of the pair of hydraulic actuators 51 and 53.

In the derrickless system 100 of the present invention, the coordinated movement of each of the members of the first and second tubular handling apparatuses 10 and 116 is achieved with proper sizing and angular relationships. In essence, the present invention provides a four-bar link between the various components. As a result, the movement of the tubular 18 between a horizontal orientation and a vertical orientation may be achieved purely through the mechanics associated with the various components. Only a single hydraulic actuator may be necessary for each of the first and second tubular handling apparatuses 10 and 116 so as to achieve the desired movement. Neither of the tubular handling apparatuses 10 and 116 requires coordinated movement of multiple hydraulic actuators. The hydraulic actuators are only used for the pivoting of the main rotating structural members 16 and 17. Because the skids 12 and 13 are located on the beds 14 and 15 of a vehicle, the vehicle may be maneuvered into place so as to properly align the center line of the wellhead 108 with the center line of the tubular 18. Once proper alignment is achieved by each vehicle of the tubular handling apparatuses 10 and 116, the apparatuses 10 and 116 may be operated so as to effectively move the tubular 18 to its desired position. The gripper assemblies 26 and 25 of the first and second tubular handling apparatuses 10 and 116, respectively, allow the tubular 18 to move upwardly and downwardly for the proper stabbing of the tubular 18 on the tubular 62. Conversely, the gripper assemblies 26 and 25 of the first and second tubular handling apparatuses 10 and 116 allow the tubulars 18 to move upwardly and downwardly so as to remove the tubular 18 from the tubular 62.

Instead of the complex control mechanisms that are required with prior art tubular handling systems and apparatuses, the derrickless system 100 of the present invention achieves its results by simple maneuvering of the vehicles of the first and second tubular handling apparatuses 10 and 116, along with the operation of the hydraulic cylinders 56 and 58 of the first tubular handling apparatus 10 and the hydraulic cylinders 51 and 53 of the second tubular handling apparatus 116.

Figure 3:
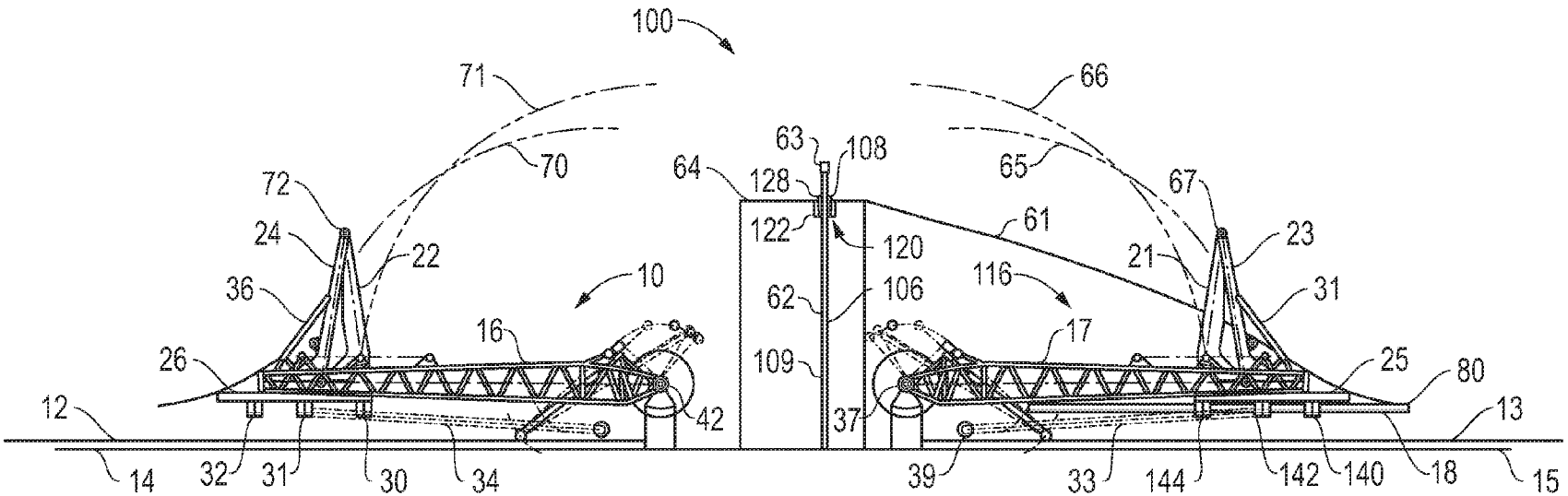
FIG. 3 shows a side elevational view of the derrickless system of the present invention, with the first and second tubular handling apparatus in the first position.

Referring to FIG. 3, there is shown a side elevational view of the preferred embodiment of the derrickless system 100 of the present invention, with the first and second tubular handling apparatuses 10 and 116 in the first position. Tubular 18 is in the stowed position. The tubular 18 can be seen in the horizontal orientation. The main rotating structural members 16 and 17 of the first and second tubular handling apparatuses 10 and 116 are also in a generally horizontal orientation when in the first position. It is important to note that the tubular 18 may be delivered to and from the gripper assemblies 26 and 25 of the tubular handling apparatuses 10 and 116, respectively, in a position below the main rotating structural members 16 and 17. In the preferred embodiment where the second tubular handling apparatus 116 delivers tubulars 18 to and from the wellhead 108, the tubular 18 may be loaded upon the skid 13 in a location generally adjacent the grippers 140, 142, and 144 associated with the gripper assembly 25. As such, the present invention facilitates the easy delivery of the tubular 18 to the wellhead 108. The grippers 140, 142, and 144 of the gripper assembly 25 of the second tubular handling apparatus 116 grip the surface 104 of the tubular 18 in the horizontal orientation. In the first position, the main rotating structural member 17 resides above the tubular 18 and in generally parallel relationship to the top surface of the skid 13. The lever assembly 21 is suitably pivoted so that the arm 23 extends through the interior of the frame work of the main rotating structural member 17 such that the gripper assembly 25 engages the tubular 18. The brace 31 resides in connection with the small frame member 41 of the main rotating structural member 17 and is also pivotally connected to the arm 23. The link 33 resides below the main rotating structural member 17 generally adjacent to the upper surface of the skid 13 and is connected to the second portion 45 of the lever assembly 21 below the main rotating structural member 17. When the second tubular handling apparatus 116 moves from the first position to the second position, the lever assembly 21 is pivoted so that the end 80 of the tubular 18 passes through the interior of the frame work of the main rotating structural member 17. The arm 23 associates with the gripper assembly 25 so as to move the stab frame 138 of the gripper assembly 25 through the interior of the frame work of the main rotating structural member 17. The brace 31 pulls the first portion 43 of the lever assembly 21 so as to cause this motion to occur. The link 33 pulls on the end of the second portion 45 of the lever assembly 21 so as to draw the first portion 43 upwardly and to cause the movement of the stab frame 138 of the gripper assembly 25. The hydraulic actuators 51 and 53 operate so as to urge the main rotating structural member 17 upwardly. The movement of the various parts of the second tubular handling apparatus 116 described hereinabove also applies substantially similarly to the first tubular handling apparatus 10.

In order to install the tubular 18 upon the tubular 62, it is only necessary to vertically translate the grippers 30, 31, and 32 with respect to the stab frame 28 of the gripper assembly 26 of the first tubular handling apparatus 10 and to vertically translate the grippers 140, 142, and 144 within the stab frame 138 of the gripper assembly 25 of the second tubular handling apparatus 116. As such, the end 80 of the tubular 18 may be stabbed into the box at the end 63 of the tubular 62. Suitable tongs, spinner or other mechanisms may be utilized so as to rotate the tubular 18 in order to connect or disconnect the tubular 18 with the tubular 62.

Figure 4:
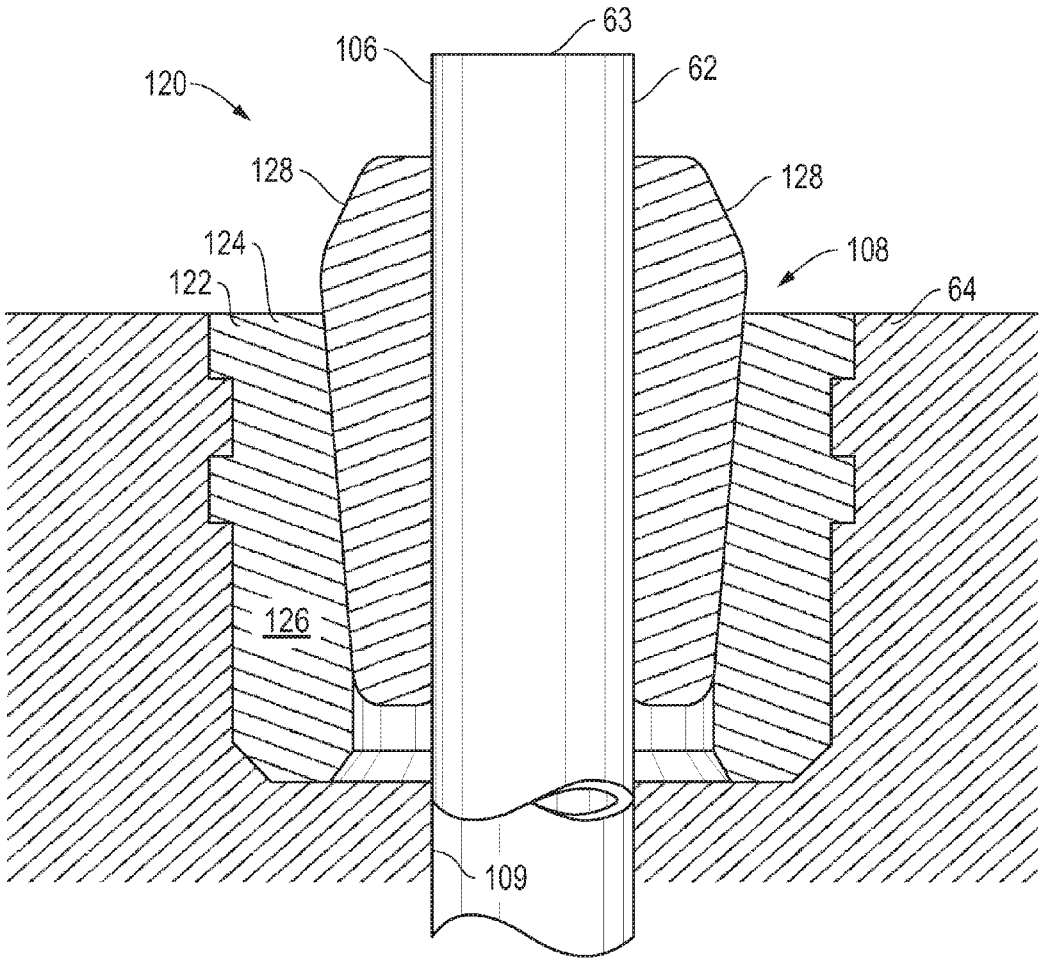
FIG. 4 shows a cross section view of the preferred embodiment of the slip assembly of the present invention.

Referring to FIG. 4, there is shown a cross sectional view of the slip assembly 120 of the present invention. The slip assembly 120 is positioned in the wellhead 108. The tubular 62 is positioned in the wellbore 109. The tubular 62 extends through the slip assembly 120 so as to have an end 63 positioned above the wellhead 108 of the wellbore 109. The slip assembly 120 has a wedge bowl 122 positioned at the wellhead 108. The wedge bowl 122 receives the tubular 62 therein. Wedges 128 are positioned in the wedge bowl 122. The wedges 128 are positioned between the wedge bowl 122 and the surface 106 of the tubular 62. The slip assembly 120 is suitable for supporting the weight of the tubular 62 in the case that the grippers of the first and second tubular handling apparatuses 10 and 116 drop the end 63 of the tubular 62. The wedge bowl 122 has a wide end 124 and a narrow end 126. The wide end 124 has an inner diameter that is greater than a diameter of the narrow end 124. The wedges 128 are positioned adjacent the wide end 124 of the wedge bowl 122. In the event that the grippers of the first and second tubular handling apparatuses 10 and 116 drop the end 63 of the tubular 62, the downward motion of the tubular 62 causes the wedges 128 to travel into the interior of the wedge bowl 122. As the wedges 128 and tubular 62 travel downwardly into the wellbore 109, the wedge bowl 122 exerts radially inward forces upon the wedges 128, which in turn exert radially inward forces on the surface 106 of the tubular 62 so as to stop the tubular 62 from moving downwardly into the depths of the wellbore 109. The slip assembly 120 is generally located in the well floor 64 at the wellhead 108. The wedge bowl 122 of the slip assembly 120 is generally tubular in shape and receives the tubular 62. The wedges 128 may be of any number suitable for holding the weight of the tubular 62. Moreover, the shape and design of the wedges 128 and wedge bowl 122 may be of any shape and design suitable for holding the tubular 62.

Figure 5:
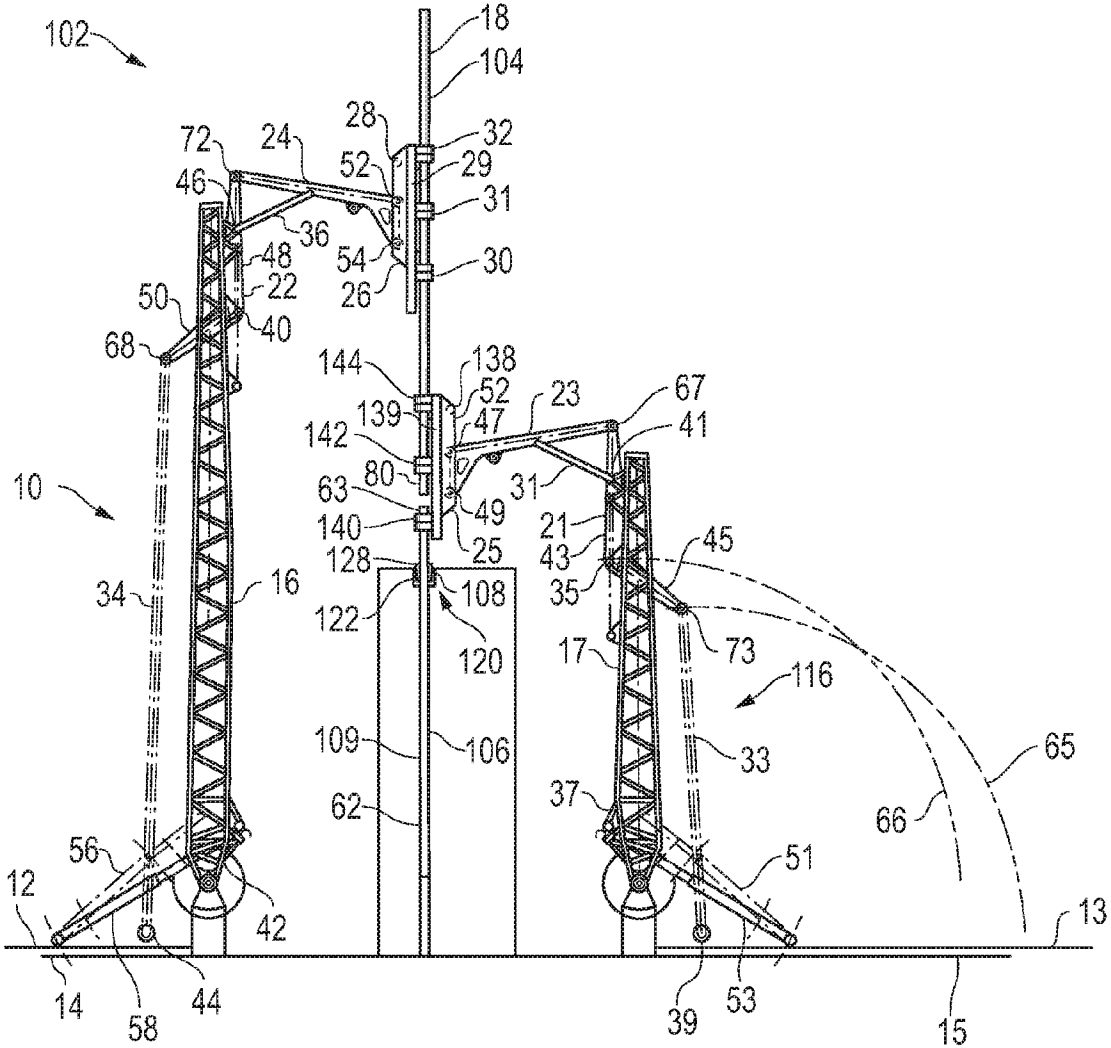
FIG. 5 shows a side elevational view of an alternative embodiment of the derrickless system of the present invention, with the first and second tubular handling apparatuses in the second position.

Referring to FIG. 5, there is shown an alternative embodiment of the derrickless system 102 of the present invention, with the first and second tubular handling apparatuses 10 and 116 in the second position. The configuration of the alternative embodiment of the derrickless system 102 is the same as that shown in the preferred embodiment in FIGS. 1-4 except that the grippers 30, 31, and 32 of the gripper assembly 26 of the first tubular handling apparatus 10 are located above the grippers 140, 142, and 144 of the gripper assembly 25 of the second tubular handling apparatus 116 when the first and second tubular handling apparatuses 10 and 116 are in the second position. The grippers 142, 144, 30, 31, and 32 have moved the tubular 18 vertically downwardly over the wellhead 108 so as to connect end 80 of the tubular 18 with end 63 of the tubular 62. Once again, slip assembly 120 is used in the alternative embodiment of the apparatus 102 so as to ensure that tubular 62 does not plunge into the depths of the wellbore 109 in the event that gripper 140 fails to hold the end 63 of the tubular 62 above the wellhead 108. The movement of the various parts of the first and second tubular handling apparatuses 10 and 116 is the same as the movements shown in FIGS. 1-3 for the preferred embodiment of the derrickless system 100. The slip assembly 120 is the same slip assembly 120 shown in FIGS. 1-4.

The present invention achieves a number of advantages over the prior art. Most importantly, the present invention provides a derrickless system and method that minimizes the number of control mechanisms, sensors and hydraulic systems associated with the tubular handling system. Since the movement of the tubular is achieved in a purely mechanical way, only a single hydraulic actuator is necessary for the movement of the main rotating structural member. All of the other movements are achieved by the interrelationship of the various components. As such, the present invention achieves freedom from the errors and deviations that may occur through the use of multiple hydraulic systems. The simplicity of the present invention facilitates the ability of a relatively unskilled worker to operate the tubular handling system. The amount of calibration is relatively minimal. Since the skids associated with the present invention may be transported by a truck, various fine movements and location of the tubular handling apparatus may be achieved through the simple movement of the vehicle. The tubular handling apparatus of the present invention is independent of the drilling rig. As such, a single tubular handling apparatus that is built in accordance with the teachings of the present invention may be utilized on a number of rigs and may be utilized at any time when required. There is no need to modify the drilling rig, in any way, to accommodate the tubular handling apparatus of the present invention. Since the tubulars are loaded beneath the main rotating structural member, the providing of the tubular to the tubular handling apparatus may be achieved in a very simple manner. There is no need to lift the tubulars to a particular elevation or orientation in order to initiate the tubular handling system.

The present invention is a method for servicing tubulars 18 and 62 at a wellhead 108. The method includes the steps of gripping a first tubular 69 by a tubular handling apparatus 100, moving the gripped first tubular 69 from a stowed position to a position above the wellhead 108, gripping a second tubular 62 by the tubular handling apparatus 100, moving the gripped second tubular 62 from a stowed position to a position above the wellhead 108, engaging the moved second tubular 62 into an end 79 of the moved first tubular 69, releasing the first tubular 69 from the tubular handling apparatus 100, gripping a third tubular 18 by the tubular handling apparatus 100, moving the third gripped tubular 18 from a stowed position to a position above an end 63 of the second tubular 62 opposite the first tubular 69, engaging an end 80 of the third tubular 18 into the end 63 of the second tubular 62, lowering the first tubular 69 and the engaged second tubular 62 into a wellbore 109 below the wellhead 108, and fixing a position of the lowered first and second tubulars 69 and 62 relative to the wellhead 108. The tubular handling apparatus 100 comprises a first tubular handling apparatus 10 and a second tubular handling apparatus 116. The first tubular handling apparatus 10 is independent of the second tubular handling apparatus 116. The step of gripping the first tubular 69 is accomplished by the first tubular handling apparatus 10. The step of gripping the second tubular 62 is accomplished by the second tubular handling apparatus 116. The step of fixing comprises engaging one of the first and second tubulars 69 and 62 by a slip assembly 120 positioned at the wellhead 108. The step of moving the first tubular 69 is in a single degree of freedom between the stowed position and the position above the wellhead 108. The step of moving the second tubular 62 is in a single degree of freedom between the stowed position and the position above the wellhead 108.

The foregoing disclosure and description of the invention is illustrative and explanatory thereof. Various changes in the details of the illustrated construction may be made within the scope of the present claims without departing from the true spirit of the invention. The present invention should only be limited by the following claims and their legal equivalents.

We claim:

1. A derrickless system for servicing tubulars at a wellhead, comprising:

a first tubular handling apparatus having a pivotal first main rotating structural member;

a first gripper assembly pivotally attached to the first main rotating structural member for gripping a surface of a first tubular;

the first tubular handling apparatus suitable for moving the first tubular from a horizontal stowed position to a vertical deployed position above the wellhead;

a second tubular handling apparatus having a pivotal second main rotating structural member;

a second gripper assembly pivotally attached to the second main rotating structural member for gripping a surface of a second tubular;

the second tubular handling apparatus suitable for moving the second tubular from a horizontal stowed position to a vertical deployed position above the first tubular being held by the first tubular handling apparatus; and the first tubular handling apparatus operable independent of the second tubular handling apparatus to move the first tubular from a first horizontal stowed location that is different from a second horizontal stowed location of the second tubular.

2. The system of claim 1, further comprising:

a slip assembly positioned in the wellhead.

3. The system of claim 2, the slip assembly comprising:

a wedge bowl positioned at the wellhead, the wedge bowl suitable for receiving a tubular therein; and a plurality of wedges positioned in the wedge bowl, the plurality of wedges suitable for positioning between the wedge bowl and the tubular.

4. The system of claim 3, the slip assembly further comprising:

the wedge bowl having a wide end and a narrow end;

the wide end having an inner diameter greater than an inner diameter of the narrow end;

the plurality of wedges being positioned adjacent to the wide end; and the slip assembly suitable for supporting a weight of the tubular.

5. The system of claim 1, the first gripper assembly comprising:

a first stab frame; and a first gripper attached to a side of the first stab frame, the first gripper suitable for gripping the first tubular.

6. The system of claim 5, the first gripper assembly further comprising:

a second gripper attached to the side of the first stab frame, the second gripper being positioned above the first gripper; and a third gripper attached to the side of the first stab frame, the third gripper being positioned above the second gripper, at least one of the first, second and third grippers being translatable along the first stab frame.

7. The system of claim 6, the first gripper of the first gripper assembly for gripping the surface of the first tubular when the first gripper of the second gripper assembly holds the second tubular.

8. The system of claim 5, the second gripper assembly comprising:

a second stab frame; and a first gripper attached to a side of the second stab frame, the first gripper of the second gripper assembly suitable for gripping the second tubular.

9. The system of claim 8, the second gripper assembly further comprising:

a second gripper attached to the side of the second stab frame, the second gripper being positioned above the first gripper;

a third gripper attached to the side of the second stab frame, the third gripper being positioned above the second gripper; and at least one of the first, second, and third grippers of the second tubular handling apparatus being translatable along the second stab frame.

10. The system of claim 9, the second gripper assembly further comprising:

at least one of the first, second and third grippers being rotatable to rotate the second tubular in relation to the first tubular.

11. The system of claim 1, each of the respective first and second tubular handling apparatuses further comprising:

the main rotating structural member pivotally movable between a first position and a second position;

a lever assembly pivotally connected to the main rotating structural member, the lever assembly having a first portion extending outwardly at an obtuse angle with respect to a second portion;

an arm pivotally connected at one end to the first portion of the lever assembly and extending outwardly therefrom;

a link pivotally connected to the second portion of the lever assembly, the link pivoting at an end of the second portion opposite of the first portion so as to move relative to the movement of the main rotating structural member between the first and second positions; and a brace having an end pivotally connected to the main rotating structural member and an opposite end pivotally connected to the arm.

12. The system of claim 11, the first and second stab frames of the first and second tubular handling apparatuses each being affixed to an opposite end of the respective first and second arms.

13. The system of claim 11, the first and second tubular handling apparatuses each further comprising:

a skid extending in a horizontal orientation and positioned below the main rotating structural member, the main rotating structural member being pivotally mounted upon the skid; and a vehicle having a bed receiving the skid thereon.

14. The system of claim 13, further comprising:

the links of the respective first and second tubular handling apparatuses each having an end opposite the second portion of the lever assembly; and the end of the link being pivotally mounted upon the skid in a position offset from and below the pivotal mounting of the main rotating structural member on the skid.

15. The system of claim 11, wherein the main rotating structural member is a boom, the boom moving between the first and second positions within a single degree of freedom.

16. The system of claim 1 further comprising:

the second tubular handling apparatus capable of moving the first tubular from a horizontal stowed position to a vertical deployed position above the wellhead; and, the first tubular handling apparatus capable of moving the second tubular from a horizontal stowed position to a vertical deployed position above the first tubular being held by the second tubular handling apparatus.

17. The system of claim 1, further comprising:

the second tubular handling apparatus capable of positioning the second tubular in a vertical deployed position above the vertical deployed position of the first tubular by the first tubular handling apparatus.

18. The system of claim 1, further comprising:

the first main rotating structural member having a first length;

the second main rotating structural member having a second length; and, the lengths of the first main rotating structural member and the second main rotating structural member being unequal.

19. A method for installing tubulars at a wellhead comprising:

gripping a first tubular by a first tubular handling apparatus;

moving the gripped first tubular from a horizontal stowed position to a vertical deployed position above the wellhead;

gripping a second tubular by a second tubular handling apparatus located adjacent to, and laterally spaced apart from, the first tubular apparatus and the wellhead;

moving the gripped second tubular from a horizontal stowed position to a vertical deployed position above the first tubular being held by the first tubular handling apparatus;

engaging the moved second tubular into an upper end of the moved first tubular;

releasing the first tubular from the tubular handling apparatus; and wherein the first tubular handling apparatus is operable independent of the second tubular handling apparatus to move the first tubular from a first horizontal stowed location that is different from a second horizontal stowed location of the second tubular.

20. The method of claim 19, further comprising:

gripping a third tubular by the first tubular handling apparatus;

moving the third tubular from a stowed position to a position above an end of the second tubular opposite the first tubular; and engaging an end of the third tubular into the end of the second tubular.

21. The method of claim 19, further comprising:

lowering the first tubular and the engaged second tubular into a wellbore below the wellhead; and fixing a position of the lowered first and second tubulars relative to the wellhead.

22. The method of claim 21, the step of fixing a position of the lowered first and second tubulars comprising:

engaging one of the first and second tubulars by a slip assembly positioned at the wellhead.

23. The method of claim 19, the step of moving the first tubular being in a single degree of freedom between the horizontal stowed position and the vertical deployed position above the wellhead; the step of moving the second tubular being in a single degree of freedom between the stowed position and the deployed position above the first tubular.

24. The method of claim 19 wherein:

the second tubular handling apparatus capable of moving the first tubular from a horizontal stowed position to a vertical deployed position above the wellhead; and, the first tubular handling apparatus capable of moving the second tubular from a horizontal stowed position to a vertical deployed position above the first tubular being held by the second tubular handling apparatus.

25. The method of claim 19, the step of engaging the second tubular into an end of the first tubular further comprises: rotating the second tubular in relation to the first tubular.

* * * * *